United States Patent [19]

Yasuda et al.

[11] Patent Number: 4,833,882

[45] Date of Patent: May 30, 1989

[54] EXHAUST MANIFOLD FOR MULTICYLINDER INTERNAL COMBUSTION ENGINE

[75] Inventors: Makoto Yasuda, Yokohama; Hiroshi Shimamura, Tokyo, both of Japan

[73] Assignees: Nissan Motor Co., Ltd., Yokohama; Nihon Radiator Co., Ltd., Tokyo, both of Japan

[21] Appl. No.: 111,484

[22] Filed: Oct. 16, 1987

[30] Foreign Application Priority Data

Oct. 28, 1986 [JP] Japan ..... 61-164321[U]

[51] Int. Cl.[4] ..... F01N 3/18

[52] U.S. Cl. ..... 60/276

[58] Field of Search ..... 60/276

[56] References Cited

U.S. PATENT DOCUMENTS 4,484,440 11/1984 Oki ..... 60/276

4,656,830 4/1987 Ohno ..... 60/276

FOREIGN PATENT DOCUMENTS 60-3225 4/1985 Japan .

*Primary Examiner*—Douglas Hart

*Attorney, Agent, or Firm*—Pennie & Edmonds

[57] ABSTRACT

An exhaust manifold for a multicylinder type internal combustion engine has a connector is employed for connecting downstream ends of gas conduits to upstream ends of a forked exhaust pipe. The connector is of a monolithic casting and comprises a base plate portion having openings respectively connected to the upstream ends of the forked exhaust pipe, two collar portions intergrally formed on the base plate portion and having respective bores merged with the openings of the base plate portion respectively. The downstream ends of the gas conduits are sealingly received in the collar portions. A sensor mount is integrally formed on the connector for mounting a gas sensor. The sensor mount has a bore which is exposed to the interior of both the two collar portions.

8 Claims, 5 Drawing Sheets

EXHAUST MANIFOLD FOR MULTICYLINDER INTERNAL COMBUSTION ENGINE

BACKGROUND OF THE INVENTION

1. Field of the Invention

The present invention relates in general to an exhaust manifold for a multicylinder internal combustion engine, and more particularly to an exhaust manifold which is designed to exhibit excellent durability against heat applied thereto.

2. Description of the Prior Art

Hitherto, various types of exhaust manifolds for a multicylinder type internal combustion engine have been proposed and put into practical use. One of them is disclosed in Japanese Utility Model First Provisional Publication No. 60-3225.

The exhaust manifold proposed by the Publication is shown in FIGS. 7 and 8 of the attached drawings, as being generally designated by reference numeral 1. As is seen from FIG. 7, the manifold 1 comprises generally a plurality of branch runners 4 each having an upstream end connected through a flange 3 to an exhaust port 2 formed in a cylinder head (not shown) of the engine. The two outside branch runners 4 are united at their downstream portions to form a leftside united hollow portion 5*a*, while the other two inside branch runners 4 are also united at their downstream portions to form a rightside united hollow portion 5*b* which is arranged beside the leftside united hollow portion 5*a*. These two united hollow portions 5*a* and 5*b* are connected at their downstream ends to a common flange 6 by welding. In order to install an exhaust gas sensor 7 or the like to the exhaust manifold 1, there is provided a sensor mount 8 in the form of a collar at the position where the inside walls of the two united hollow portions 5*a* and 5*b* are attached to each other. As is seen from FIG. 8, the sensor 7 is tightly disposed on the sensor mount 8 having its probe portion 7*a* exposed to the interior of the united hollow portions 5*a* and 5*b*.

However, the exhaust manifold 1 has some drawbacks which will be described in the following.

Usually, during operation of the engine, the united hollow portions 5*a* and 5*b* are heated up to a temperature of about 800° C. to 900° C. because of poor heat radiation appearing at these portions. This causes reduction in mechanical strength of the united hollow portions 5*a* and 5*b*. In fact, heating these portions to such high temperature brings about elongation of the branch runners 4 generating a remarkable thermal stress at the welded portion between the runners 4 and the common flange 6 as well as the welded portion between the runners 4 and the sensor mount 8. Thus, it sometimes occurs that the welded portions are broken and the common flange 6 is deformed causing a leakage of exhaust gas through a crack formed in the welded portions.

Furthermore, preparation of such a separate common flange 6 and a separate sensor mount 8 which are to be welded to the united hollow portions 5*a* and 5*b* thereafter brings about increase in production cost of the exhaust manifold 1.

SUMMARY OF THE INVENTION

It is therefore an object of the present invention to provide an exhaust manifold which is free of the above-captioned drawbacks.

According to the present invention, there is provided an exhaust manifold interposed between an engine and an exhaust pipe, which manifold comprises a plurality of branch runners each being connected to an exhaust port of the engine; a gas conduit to which the branch runners are connected; a connector for connecting a downstream end of the gas conduit to the exhaust pipe, the connector comprising a base plate portion having an opening to which an upstream end of the exhaust pipe is connected, a collar portion to integrally mounted on the base plate portion and having a bore which is merged with the opening of the base plate portion, the collar portion sealingly putting therein the downstream end of the gas conduit; and a sensor mount integrally formed on the connector, the sensor mount having a bore which is exposed to the interior of the collar portion.

BRIEF DESCRIPTION OF THE DRAWINGS

FIGS. 1 to 6 are drawings showing an exhaust manifold of the present invention, in which:

FIG. 1 is a perspective view of an essential part of the exhaust manifold of the present invention;

FIG. 2 is a schematically illustrated sectional view of a V-type internal combustion engine to which the exhaust-manifold of the invention is practically applied;

FIG. 3 is a plan view of the V-type internal combustion engine;

FIG. 4 is a side view of a connector which is a part of the exhaust manifold of the invention;

FIG. 5 is a bottom view of the connector of FIG. 4; and

FIG. 6 is a view similar to FIG. 1, but taken front a different direction;

FIGS. 7 and 8 are drawings showing the conventional exhaust manifold which has been described hereinabove, in which:

FIG. 7 is a front view of the conventional exhaust manifold; and

FIG. 8 is an enlarged sectional view taken along the line VIII—VIII of FIG. 7.

DETAILED DESCRIPTION OF THE DRAWINGS

Referring to FIGS. 1 to 6 of the attached drawings, there is shown an exhaust manifold of the present invention, which is generally designated by numeral 10.

Figure 1:
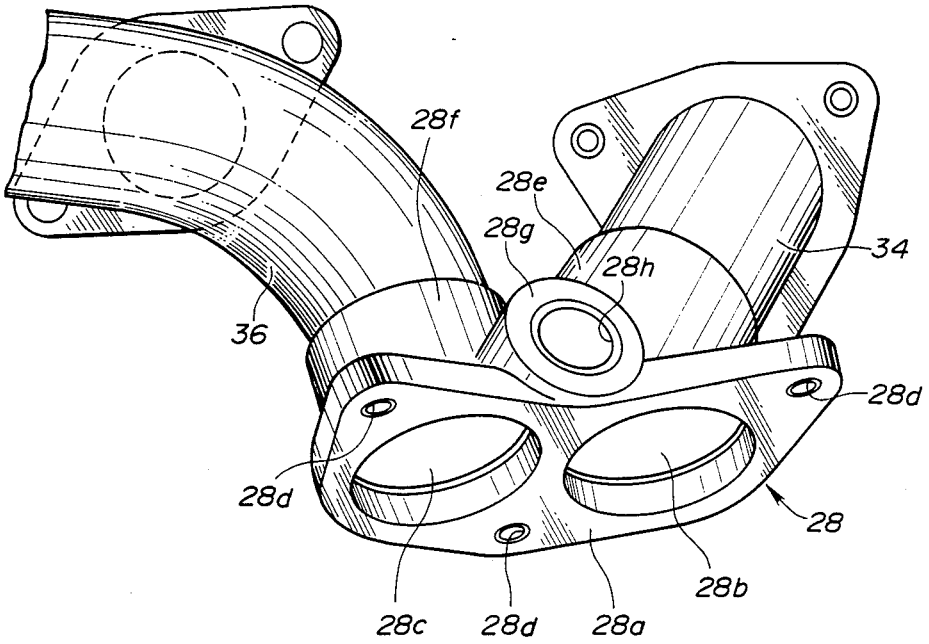
Figure 2:
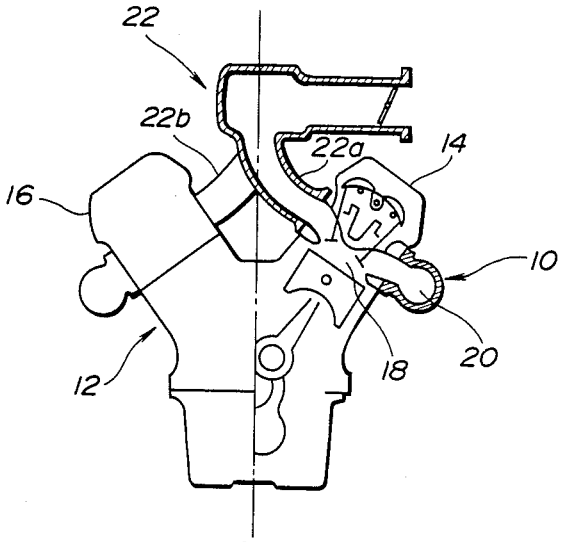
Figure 3:
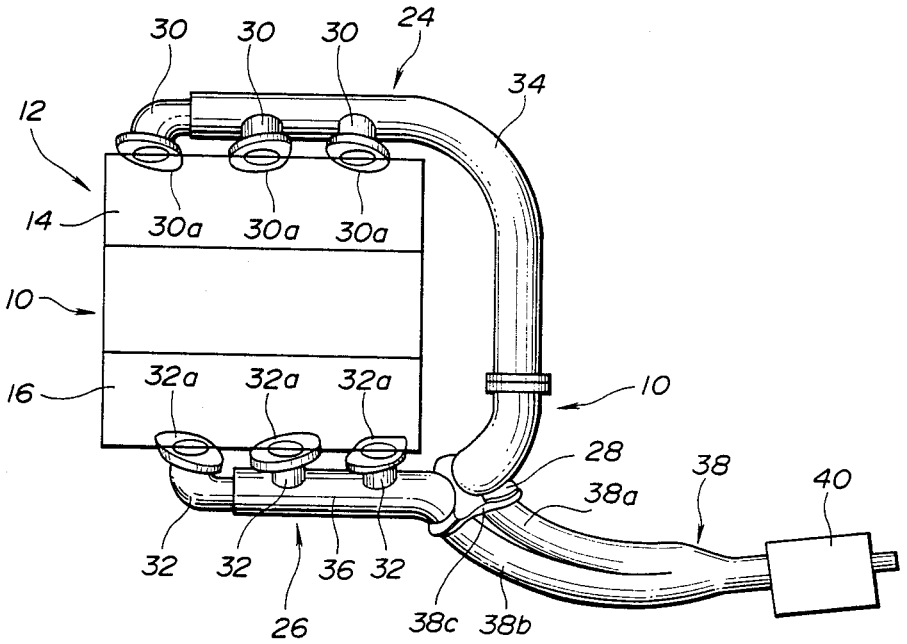
Figure 4:
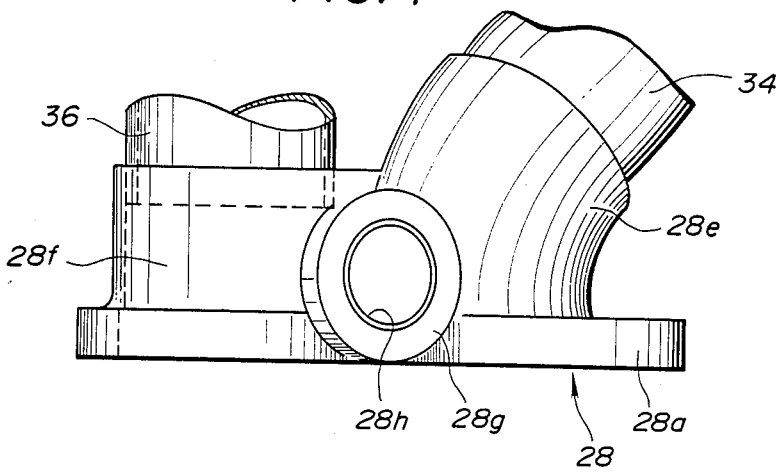
Figure 5:
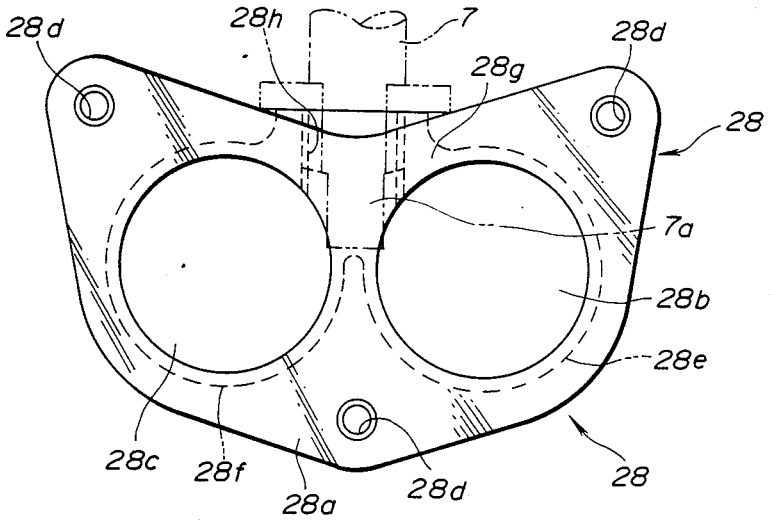
Figure 6:
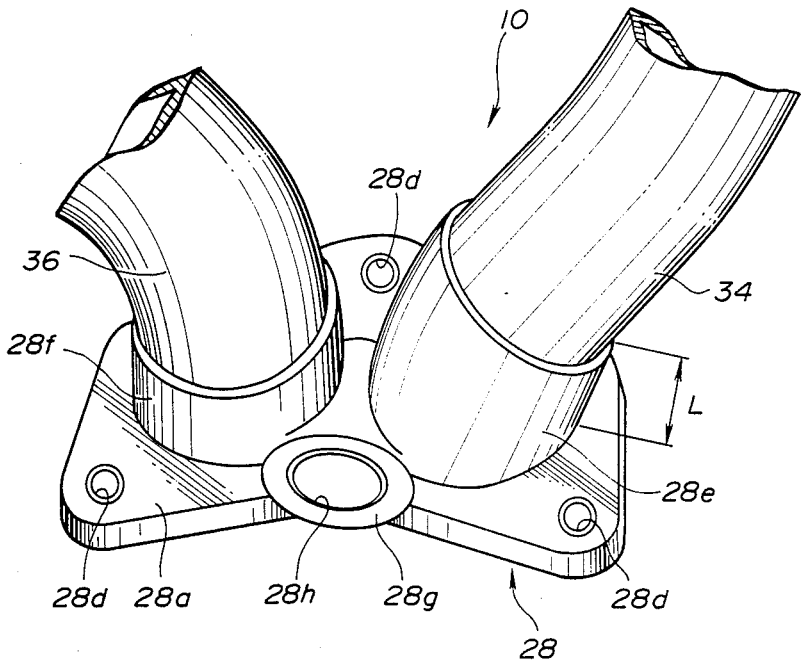
Figure 7:
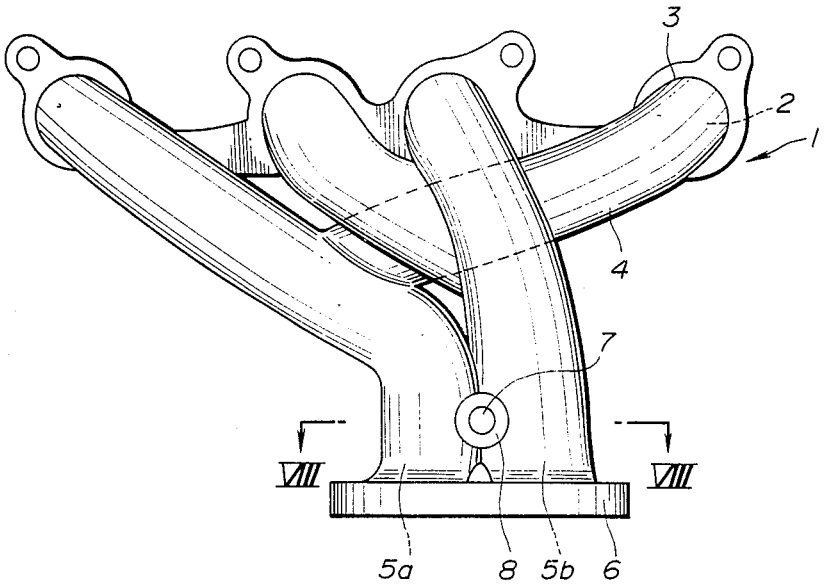
Figure 8:
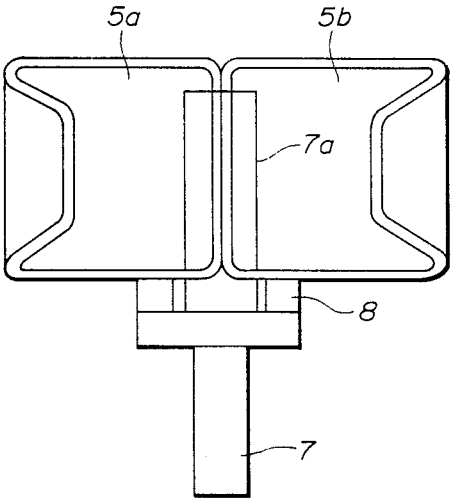

Referring to FIGS. 2 and 3, there is shown a V-type 6-cylinder internal combustion engine 12 to which the exhaust manifold 10 of the invention is practically applied. Right and left cylinder heads 14 and 16 (as viewed in FIG. 2) of the engine 10 are each formed with three combustion chambers 18 which are respectively communicated with three exhaust ports 20 formed in the cylinder head. Designated by numeral 22 in FIG. 2 is a known intake system which comprises an intake manifold having branch runners 22*a* and 22*b* connected to intake ports (no numerals) of the combustion chambers.

As is seen from FIG. 3, the exhaust manifold 10 of the invention generally comprises a first or longer conduit part 24, a second or shorter conduit part 26 and a connector 28 which holds downstream ends of the first and second conduit parts 24 and 26.

Each conduit part 24 or 26 comprises three branch runners 30 or 32 each having a flange 30*a* or 32*a* for connection with the exhaust port 20 of the associated combustion chamber. The branch runners 30 or 32 of each part 24 or 26 are connected to a longer or shorter gas conduit 34 or 36 which leads to the connector 28. The gas conduit 34 or 36 is constructed of a heat resisting metal, such as stainless steel or the like. Preferably, the conduit 34 or 36 is of a seamless pipe or a press-formed pipe. In the disclosed embodiment, the longer gas conduit 34 is curved to extend across the engine proper 10.

The connector 28 holds the downstream ends of the gas conduits 34 and 36 and holds upstream ends of two inlet pipe portions 38*a* and 38*b* of a forked exhaust pipe 38 in a manner as will be described in detail hereinafter. As is seen from FIG. 3, for connection with the connector 28, the upstream ends of the inlet pipe portions 38*a* and 38*b* have a common flange 38*c*. The downstream united end of the forked exhaust pipe 38 is led to a muffler 40.

As will be well understood from FIGS. 1 and 4 to 6, the connector 28 is of a monolithic casting, which comprises a base plate portion 28*a* serving as a flange. The base plate portion 28*a* has two circular openings 28*b* and 28*c* formed therein, which are merged with the interior of both the inlet pipe portions 38*a* and 38*b* of the forked exhaust pipe 38 when the flange 38*c* of the pipe 38 is properly connected or bolted to the base plate portion 28*a* of the connector 28. For this bolt connection, three threaded bores 28*d* are formed in the base plate 28*a*.

The connector 28 further comprises two collar portions 28*e* and 28*f* which are integrally mounted on the base plate portion 28*a* in a manner to allow the interiors thereof to be merged with the two openings 28*b* and 28*c* of the base plate portions 28*a* respectively. As is best seen from FIG. 6, the two collar portions 28*e* and 28*f* sealingly receive the downstream ends of the gas conduits 34 and 36. For this, the inner diameters of the collar portions 28*e* and 28*f* are determined to match with the outer diameters of the downstream ends of the as conduits 34 and 36. In order to achieve assured connection between each collar portion 28*e* or 28*f* and the corresponding gas conduit 34 or 36, the collar portion has a sufficient length "L". Upon assembly, the gas conduits 34 and 36 are welded to the collar portions 28*e* and 28*f*.

The connector 28 further comprises a sensor mount portion 28*g* which is located at the position between the roots of the two collar portions 28*e* and 8*f*. As is seen from FIG. 1, a part of the sensor mount portion 28*g* is merged with the base plate portion 28*a*. The sensor mount portion 28*g* is formed with a cylindrical bore 28*h* which is exposed to the interior of both the collar portions 28*e* and 28*f*. As is seen from FIG. 5, an exhaust gas sensor 7 is tightly disposed in the bore 28*h* of the sensor mount portion 28*g* having its probe portion 7*a* exposed to both the interiors of the two collar portions 28*e* and 28*f* of the connector 28.

In the following, advantages of the exhaust manifold 10 of the present invention will be described.

Similar to the case of the afore-mentioned conventional exhaust manifold 1, during operation of the engine, the downstream end portions of the gas conduits 36 and 38 are heated up to a temperature of about 800° C. to 900° C. Thus, the pipes 36 and 38 are thermally elongated thereby generating a thermal stress at the welded portions where the downstream ends of the gas conduits 34 and 36 and the collar portions 28*e* and 28*f* of the connector 28 are welded.

However, in the invention, the monolithic and thus massive construction of the connector 28 increases the mechanical strength of the welded portions between the collar portions and the gas-gathering pipes. Thus, even when a remarkable thermal stress is applied to such welded portions, the latter is prevented from forming a crack or the like. Thus, the undesired gas leakage does not occur.

Furthermore, due to its integral connection to the connector 28, the sensor mount portion 28*g* can serve as a reinforcing member of the same.

Furthermore, since the connector 28 is constructed of a monolithic casting, the production cost of the same and thus that of the exhaust manifold 10 are reduced as compared with the afore-mentioned conventional exhaust manifold 1. In fact, the conventional manifold 1 is constructed by welding numerous parts. As is known, the casting can facilitate formation of complicated configuration of articles to be produced.

Although the foregoing description is directed to an example in which the downstream ends of the gas conduits 34 and 36 are received in the collar portions 28*e* and 28*f* of the connector 28, the downstream ends of the pipes may receive therein the collar portions. Furthermore, if desired, caulking technique may be employed for connecting the ends of the conduits 34 and 36 and the collar portions 28*e* and 28*f*.

What is claimed is:

1. An exhaust manifold adapted to be interposed between an engine and an exhaust pipe, comprising:

a plurality of branch runners each being connected to an exhaust port of the engine;

a gas conduit to which said branch runners are connected;

a connector for connecting a downstream end of said gas conduit to said exhaust pipe, said connector comprising a base plate portion having an opening to which an upstream end of said exhaust pipe is connected, and a collar portion integrally mounted on said base plate portion having a cylindrical bore thereof aligned and merged with said opening of the base plate portion, said collar portion sealingly receiving therein the downstream end of said gas conduit; and a sensor mount cast integral with said connector, said sensor mount having a bore which leads to said cylindrical bore of said collar portion.

2. An exhaust manifold as claimed in claim 1, in which the downstream end of said gas conduit is welded to said collar portion.

3. An exhaust manifold as claimed in claim 2, in which said base plate portion is formed with a plurality of threaded bores through which bolts pass for connecting said base plate portion to a flange formed on an upstream end of said exhaust pipe.

4. An exhaust manifold interposed between a multi-cylinder internal combustion engine and a forked exhaust pipe, comprising:

first and second groups of branch runners each being connected to an exhaust port of said engine;

first and second gas conduits to which said first and second groups of branch runners are connected respectively;

a connector for connecting downstream ends of said first and second gas conduits to upstream pipe sections of said forked exhaust pipe, said connector comprising a base plate portion having two circular openings to which said upstream pipe sections of said forked exhaust pipe are exposed, two collar portions integrally formed on said base plate portions and having respective bores which are merged with said two circular opening respectively, said collar portions sealingly putting therein said downstream ends of said first and second conduits; and a sensor mount integrally formed on said connector at the position between the roots of said first and second collar portions, said sensor mount having a bore which is exposed to the interior of both said first and second collar portion.

5. An exhaust manifold as claimed in claim 4, in which a part of said sensor mount is merged with said base plate portion.

6. An exhaust manifold as claimed in claim 5, in which the downstream ends of said first and second gas conduits are welded to said first and second collar portions.

7. An exhaust manifold as claimed in claim 6, in which said base plate portion, said first and second collar portions and said sensor mount constitute a monolithic structure of casting.

8. An exhaust manifold as claimed in claim 7, in which said base plate portion is formed with a plurality of threaded bores through which bolts pass for connecting said base plate portion to a flange which is secured to upstream ends of the pipe sections of said forked exhaust pipe.

* * * * *